US006837802B1

(12) United States Patent
Santamaria

(10) Patent No.: US 6,837,802 B1
(45) Date of Patent: Jan. 4, 2005

(54) PUTTING STROKE TRAINING DEVICE

(76) Inventor: David Santamaria, 6234 NW. 16th St., Margate, FL (US) 33063

( * ) Notice: Subject to any disclaimer, the term of this patent is extended or adjusted under 35 U.S.C. 154(b) by 0 days.

(21) Appl. No.: 10/704,032

(22) Filed: Nov. 10, 2003

(51) Int. Cl.[7] ..... A63B 69/36
(52) U.S. Cl. ..... 473/258; 473/229
(58) Field of Search ..... 473/223, 225, 473/229, 257, 258, 260–265; 273/DIG. 30; 482/98, 101, 13

(56) References Cited

U.S. PATENT DOCUMENTS

| | | | | |
|---|---|---|---|---|
| 2,084,902 A | | 6/1937 | Eisenberg | |
| 3,246,898 A | | 4/1966 | Shoaf, Jr. | |
| 3,471,155 A | * | 10/1969 | Donaldson | 473/260 |
| 3,885,796 A | | 5/1975 | King | |
| 4,437,669 A | | 3/1984 | Pelz | |
| 5,125,844 A | | 6/1992 | Grant et al. | |
| 5,282,627 A | * | 2/1994 | Beck | 473/260 |
| 5,435,547 A | | 7/1995 | Lee | |
| 5,437,458 A | | 8/1995 | Springer | |
| 6,159,106 A | | 12/2000 | Adams | |
| 6,350,207 B1 | | 2/2002 | Arcuri | |
| 6,461,246 B1 | | 10/2002 | Lee et al. | |

* cited by examiner

*Primary Examiner*—Gregory Vidovich
*Assistant Examiner*—Nini F. Legesse
(74) *Attorney, Agent, or Firm*—Oltman, Flynn & Kubler

(57) ABSTRACT

A putting stroke training device having a housing with serrations on the bottom for engagement with a carpet or rug and an elongated top opening. A simulated club head is slidable in a straight line along the inside of the housing parallel to the top opening in such a manner that it cannot move upward significantly. A manually operable elongated shaft extends up from the housing at the top opening and has its lower end coupled to the simulated club head by a universal joint.

11 Claims, 3 Drawing Sheets

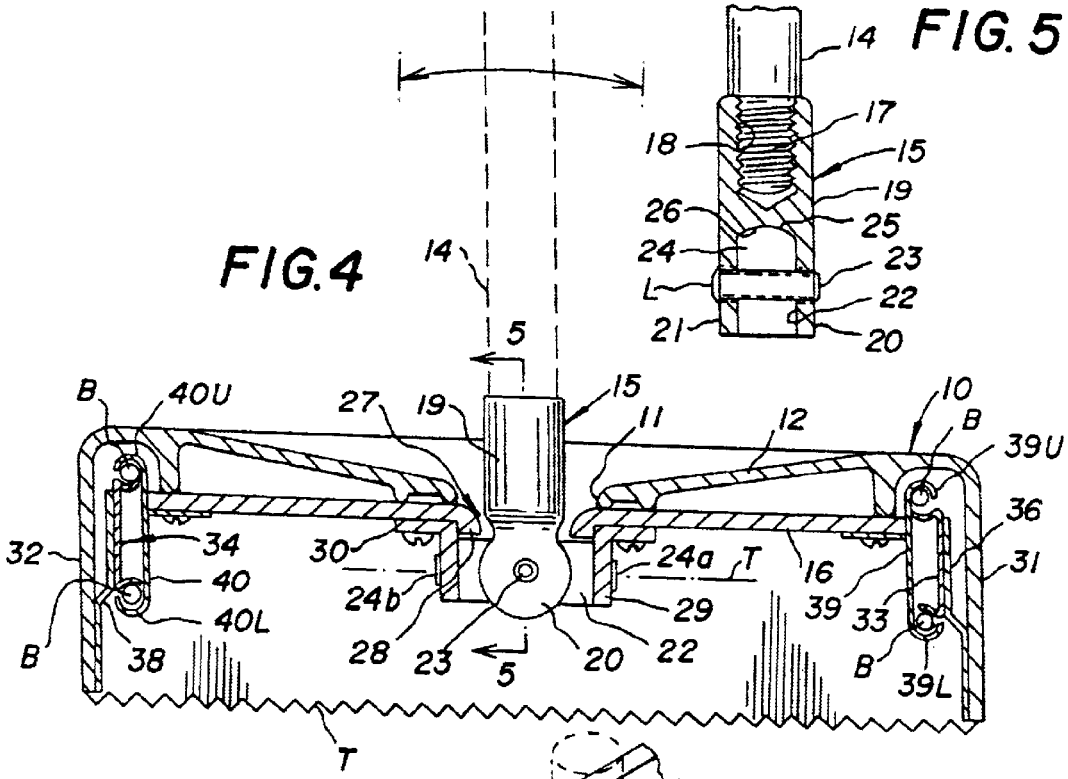
FIG. 4
14
5
B
40U
27
19
15
11
12
10
B
39U
36
32
34
30
24a
T
16
31
40
24b
29
39
33
40L
28
23
5
20
22
B
38
B
39L
T
FIG. 5
14
17
18
15
19
26
25
24
23
L
22
21
20
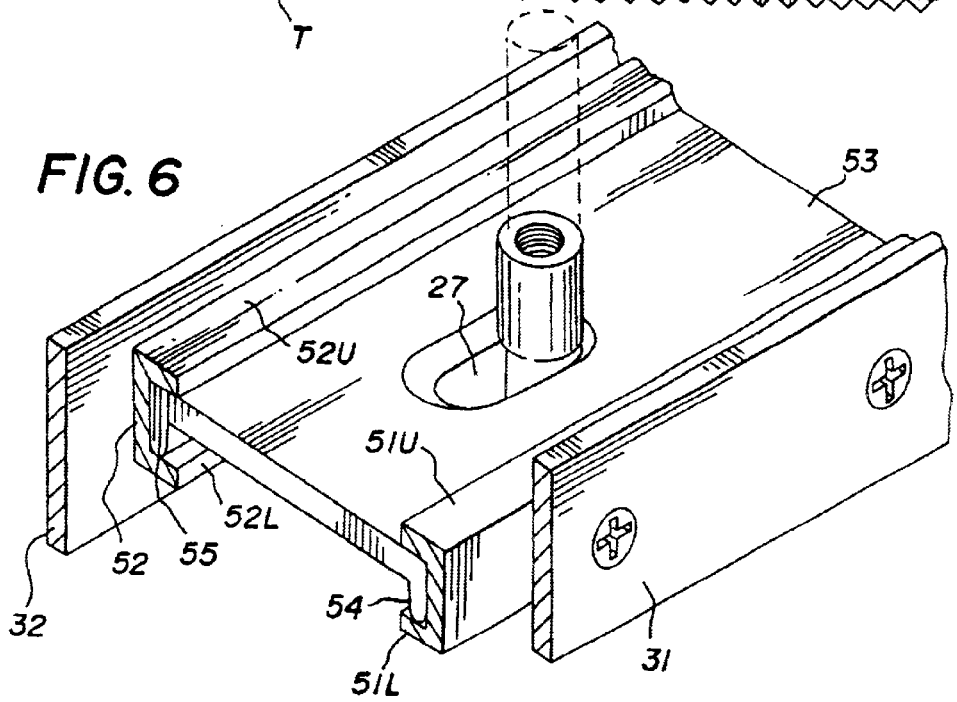
FIG. 6
53
27
52U
51U
52L
52
55
54
32
51L
31

13
14
11
10
12

15
T
FULL TRAVEL
53'
32
18
19
27
R
31
T
51
51L
54'
52
52L

PUTTING STROKE TRAINING DEVICE

BACKGROUND OF THE INVENTION

1. Field of the Invention

This invention relates to a training or practice device for aiding a golfer to master a putting stroke.

2. Prior Art

Various putting stroke training or practice devices have been proposed heretofore in which the head of an actual putter or a simulated putter is constrained to move through a predetermined arc when the user swings the putter shaft. Examples of such proposals are disclosed in the following U.S. patents: Eisenberg U.S. Pat. No. 2,084,902; Pelz U.S. Pat. No. 4,437,669; Grant et al U.S. Pat. No. 5,125,844; and Springer U.S. Pat. No. 5,437,458. In addition, Lee U.S. Pat. No. 5,435,547 proposes a device designed for arcuate movement of the putter head along a predetermined "swing arc."

Various other putting stroke training or practice devices have been proposed in which the putting head is intended to move in a straight line horizontally, but they lack any constraint against upward movement of the putter head, which would be inconsistent with the fundamental purpose of training the user to move the club head in a straight line. Devices of this type are shown in King U.S. Pat. No. 3,885,796 and Adams U.S. Pat. No. 6,159,106.

Arcuri U.S. Pat. No. 6,350,207 discloses a putting stroke training device which does limit the stroke to a horizontal straight line, but has the ball striker located a substantial distance in front of the lower end of the club shaft and in this respect does not realistically simulate what a golfer experiences when using an actual putter on a golf course.

Lee et al U.S. Pat. No. 6,461,246 discloses a putting stroke training device for use with an actual putter. It has a guideway for the head of the putter which permits upward arcuate movement of the club head at the end of the backstroke. In addition, during a putting stroke the club head has to move beyond this guideway to strike the ball and in doing so it is free to move upward.

SUMMARY OF THE INVENTION

The present invention is directed to a putting stroke training or practice device which has a simulated putter head that is restrained against upward movement during a simulated putting stroke. The preset invention limits it the simulated putter head to straight-line motion, as well as positioning the simulated putter head in the usual position abutting the lower end of the club shaft A principal object of this invention is to provide a novel and advantageous putting stroke training or practice device which trains the user to perform a straight-line stroke of a simulated putter head that is realistically positioned with respect to its club shaft essentially the same as the head of an actual putter is positioned with respect to its club shaft.

Further objects and advantages of this invention will be apparent from the following detailed description of presently preferred embodiments thereof illustrated in the accompanying drawings.

BRIEF DESCRIPTION OF THE DRAWINGS

FIG. 4 is a vertical cross-section through the upper part of this device, taken along the line 4—4 in FIG. 1;

FIG. 5 is a fragmentary vertical section at the universal joint connecting the lower end of the club shaft to the simulated club head of the device, taken along the line 5—5 in FIG. 4;

FIG. 6 is a fragmentary perspective view showing the slidable arrangement of the simulated club head in a second embodiment of the invention;

DETAILED DESCRIPTION OF THE INVENTION

Before explaining the present invention in detail it is to be understood that the invention is not limited in its application to the particular arrangements shown and described since the invention is capable of other embodiments. Also, the terminology used herein is for the purpose of description and not of limitation.

Figures 7, 8, 9:
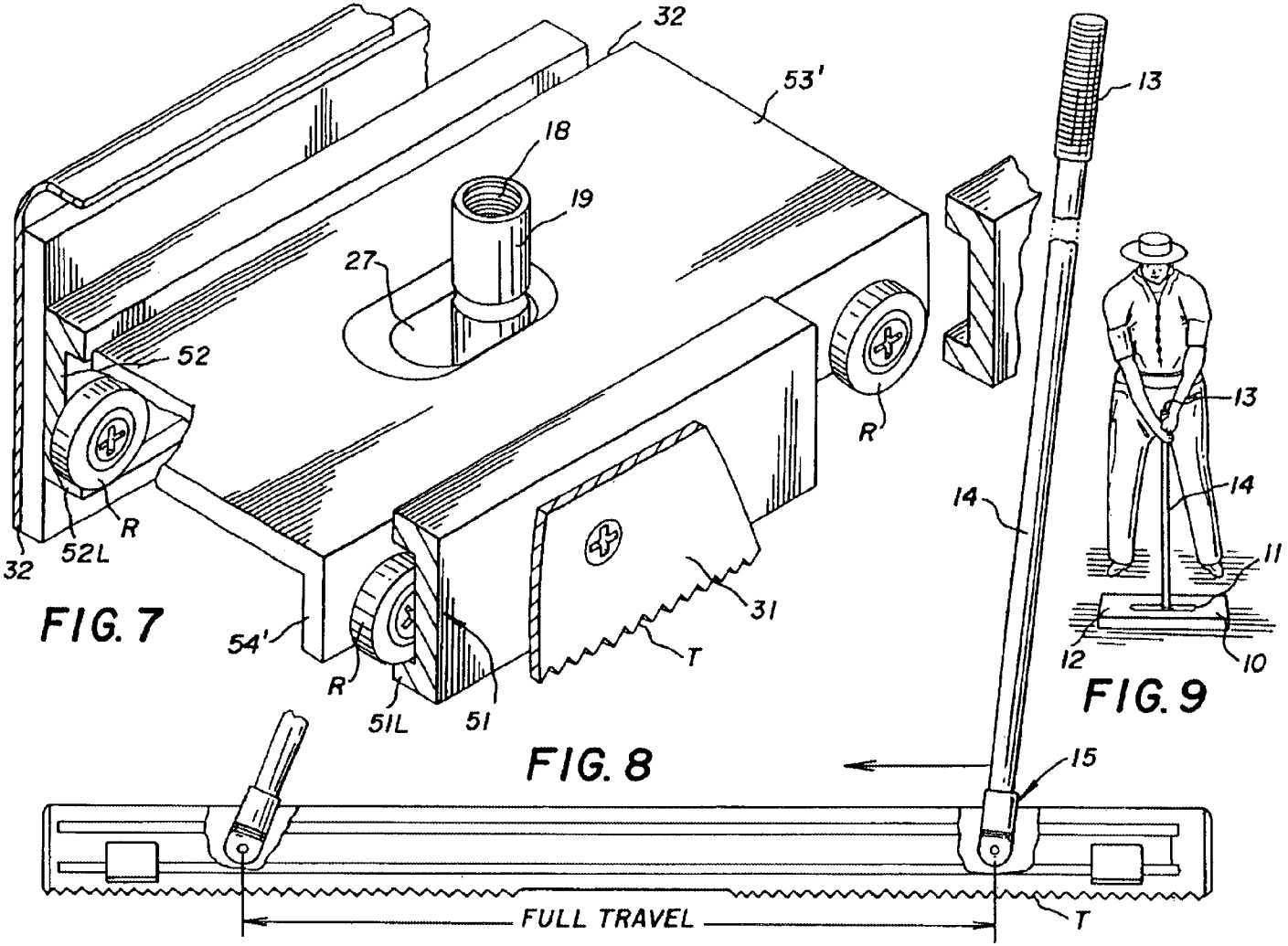
FIG. 7 is a view similar to FIG. 6 and showing the slidable arrangement of the simulated club head in a third embodiment of the invention.
FIG. 8 is a longitudinal section showing the guide rail supporting the simulated club head at one side of the device.
FIG. 9 is a perspective view showing a golfer using the present training or practice device.

Referring to FIG. 9, the putting stroke training or practice device of the present invention has an elongated, generally rectangular housing 10 with an elongated narrow opening 11 in its top wall 12. The user stands as shown in this Figure and grasps a hand grip 13 on the upper end of an elongated cylindrical shaft 14 that simulates the shaft of a putter. On the lower end of shaft 14 is a universal joint 15 (FIGS. 4, 5 and 8) which extends down through the housing opening 11 into the interior of housing 10 and is connected there to a rectangular body 16 (FIGS. 6 and 7) that simulates the club head of a putter.

As shown in FIG. 5, the lower end of shaft 14 terminates in an externally screw-threaded stem 17 which is threadedly received in a complementary screw-threaded recess 18 extending down from the top of the upper member 19 of the universal joint.—Alternatively, a golf club shaft can be epoxy glued to the upper member 19 of the universal joint.—At its lower end the universal joint member 19 presents circular ears 20 and 21 on opposite sides of a flat-sided recess 22 which is open at the bottom of universal joint member 19. A pivot pin 23 extends across recess 22 and is fixedly held in the lower end ears 20 and 21 of universal joint member 19. Pin 23 defines a first pivot axis L in the universal joint which extends along the direction of elongation of the top wall opening 11 in housing 10.

A second, lower member of the universal joint in the form of a flat-sided plate 24 is slidably received in the bottom recess 22 in the upper universal joint member 19. Plate 24 has a rounded top face 25 that slidably engages a complementary top surface 26 of recess 22. As shown in FIG. 4, the second universal joint member 24 projects laterally beyond the ears 20 and 21 and terminates in coaxial cylindrical stubs 24*a* and 24*b* which define a second axis T of the universal joint that extends perpendicular to the longitudinal axis L and intersects it.

As shown in FIG. 4, the simulated putting head 16 is formed with an oblong central opening 27 located immediately below the longitudinal top opening in housing 10. At this opening, body 16 is bent downwardly to form a flange 28 which borders the opening 27.

Right-angled brackets 29 and 30 are bolted to the bottom of the simulated club head 16 next to flange 28. The brackets rotatably receive the stubs 24*a* and 24*b* of the lower member 24 of the universal joint and support it at the transverse axis T of the universal joint.

Figure 1:
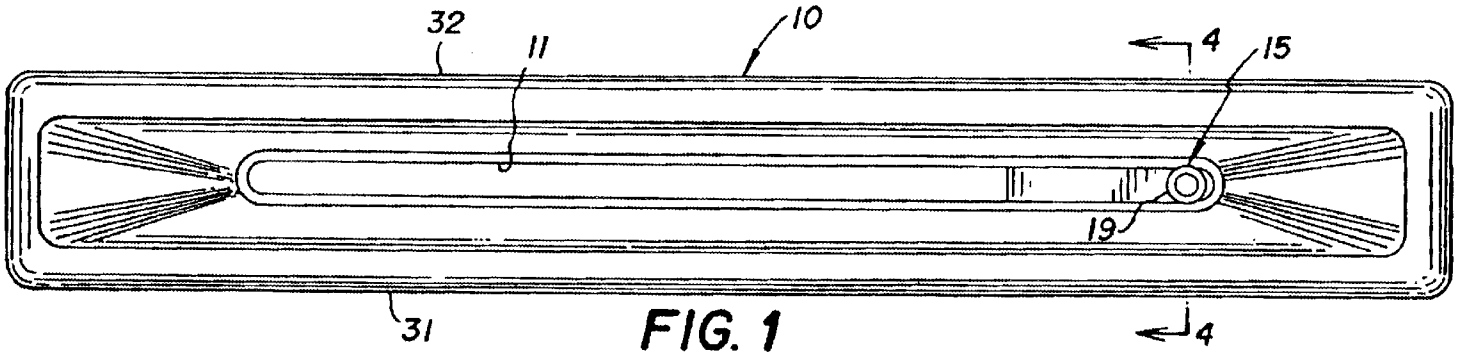
FIG. 1 is a top plan view of a first embodiment of the present invention with the club shaft detached.
Figure 2:
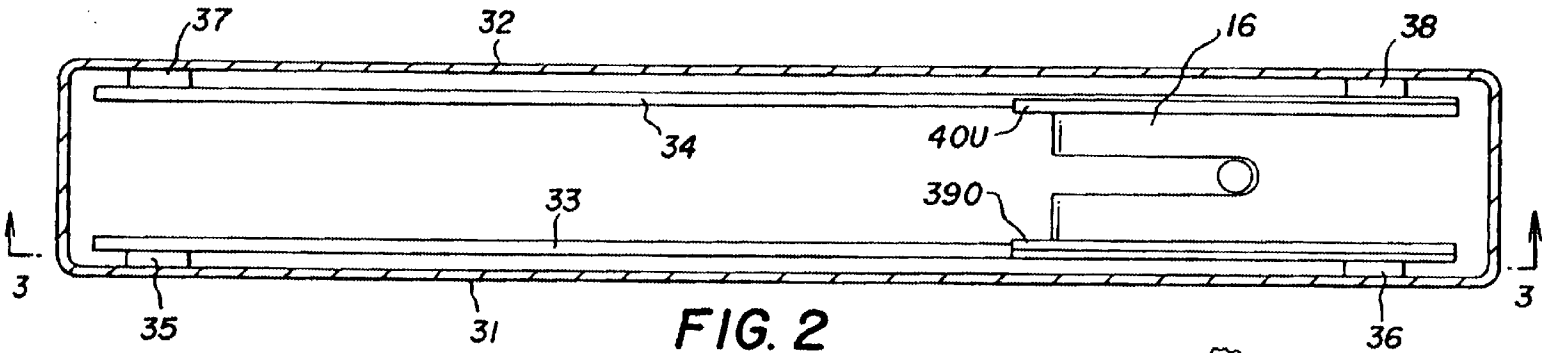
FIG. 2 is a horizontal longitudinal section through the FIG. 1 device taken just below its top wall, at line 2—2 in FIG. 3.
Figure 3:
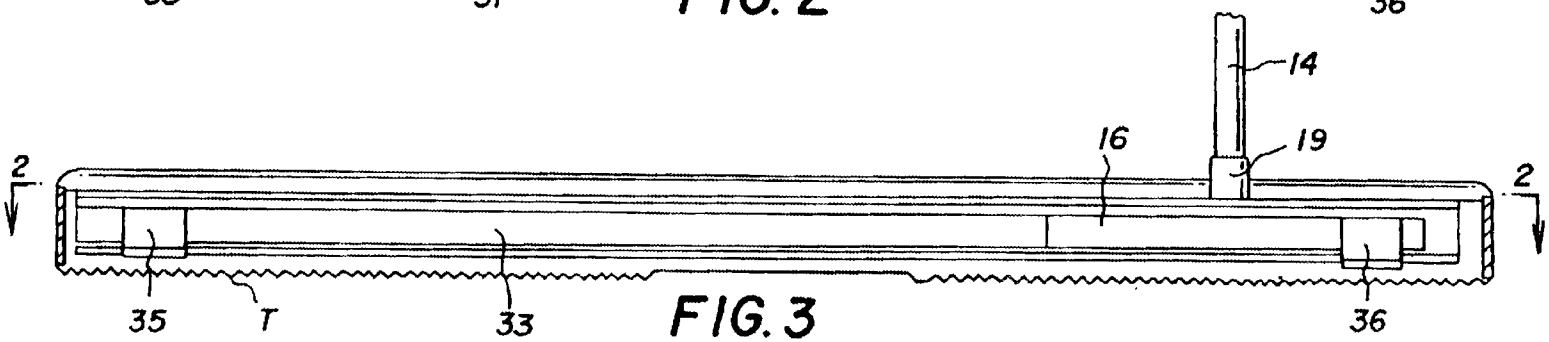
FIG. 3 is a vertical longitudinal section taken along the line 3—3 in FIG. 2.

Housing 10 has flat opposite side walls 31 and 32, each of which fixedly supports a corresponding horizontally elongated ball bearing raceway 33 or 34 extending lengthwise of housing 10 parallel to its top wall opening 11. Attachment brackets 35 and 36 (FIG. 2) affix raceway 33 to the adjacent side wall 31 of housing 10. Each of these brackets has the vertical cross-sectional shape shown for bracket 36 in FIG. 4, from which it will be evident that the inwardly offset upper part of the bracket spaces the raceway inward from the housing side wall 31. Similar brackets 37 and 38 affix the opposite raceway 34 to the adjacent side wall 32 of housing 10.

The simulated club head 16 carries respective elongated ball retainers 39 and 40, each having outwardly curved top and bottom lips 39U and 39L, and 40U and 40L, respectively, which hold upper and lower sets of anti-friction balls B against oppositely curved upper and lower lips of the corresponding raceways 39 and 40. As shown in FIG. 4, the ball retainers 39 are bolted to the bottom of simulated club head member 16.

With this arrangement, the user can practice a putting stroke by moving the handle 14 in such a manner as to slide the simulated club head 16 along the inside of housing 10 in a straight-line, horizontal path inside the housing. The user can adjust handle 14 to different angles both transverse to the housing and longitudinally of it. The sliding support for the simulated club head 16 prevents the user from deliberately or accidentally moving it upward any significant amount during the putting practicestroke.

FIG. 5 shows a second embodiment of the invention which differs from the first in the slidable support for the simulated club head. The opposite sides 31 and 32 of housing 10 carry elongated horizontal guide tracks 51 and 52 of channel-shaped cross-section with respective inwardly projecting horizontal flanges 51U, 51L, 52U and 52L at the top and bottom. The simulated club head is a flat rectangular plate 53 that spans the distance between the guide tracks and presents downwardly projecting flanges 54, each with a close running fit in the corresponding guide track. The flanges of the simulated club head have rounded bottom surfaces that slidably rest on the lower flanges 51L and 52L of the guide tracks, while the top of plate 53 has a close clearance from the top flanges 51U and 52U of the guide tracks.

FIG. 7 shows a third embodiment of the invention which is generally similar to the second but differs from it in that the simulated club head 53' does not completely span the distance between the guide tracks 51 and 52 but instead positions it opposite side flanges 54' and 55' slightly inward from the respective guide tracks. These flanges on the simulated carry rollers R which tide on the lower flanges 51L and 52L of the guide tracks and have a slight clearance from the top flanges 51U and 52U.

From the foregoing description, taken in conjunction with the accompanying drawings, it will be evident that the present invention is adapted for incorporation in a variety of embodiments, each capable of providing the desired training of a user to perform a straight-line putting stroke.

I claim:

1. A putting stroke training and device comprising:

a housing adapted to rest on a support and having an elongated top opening therein;

a manually operable elongated shaft extending up from said housing at said top opening therein;

a simulated putter club head inside said housing below said top opening;

guide means acting between said simulated club head and said housing for guiding said simulated club head in a straight-line path lengthwise of said top opening and preventing significant upward displacement of said simulated club head inside said housing;

and a coupling connecting said simulated club head to the lower end of said shaft so that said straight-line movement of the simulated club head can be effected by manipulating said shaft.

2. A putting stroke training device according to claim 1, wherein said guide means comprises:

guide tracks on the inside of said housing extending parallel to said top opening and positioned on opposite sides of said simulated club head;

and means on said opposite sides of said simulated club head slidably engaging said tracks and enabling said straight-line movement of the simulated club head.

3. A putting stroke training device according to claim 2, wherein said simulated club head has depending flanges on opposite sides thereof which slidably engage said guide tracks.

4. A putting stroke training device according to claim 2, wherein said simulated club bead carries rollers on opposite sides thereof which engage said guide tracks.

5. A putting stroke training device according to claim 2, wherein said housing has serrations on the bottom for toothed engagement with a carpe or rug.

6. A putting stroke training device according to claim 5, wherein said coupling is a universal joint enables pivotal movement of said shaft both longitudinally and transversely of said top opening in the housing.

7. A putting stroke training device according to claim 1, wherein said guide means comprises ball bearing assemblies on opposite sides of said simulated club head.

8. A putting stroke training device according to claim 1, wherein said coupling enables pivotal movement of said shaft longitudinally of said top opening in the housing.

9. A putting stroke training device according to claim 1, wherein said coupling enables pivotal movement of said shaft transversely of said top opening in the housing.

10. A putting stroke training device according to claim 1, wherein said coupling is a universal joint enables pivotal movement of said shaft both longitudinally and transversely of said top opening in the housing.

11. A putting stroke training device according to claim 1, wherein said housing has serrations on the bottom for toothed engagement with a carpet or rug.

* * * * *